US007604120B2

(12) United States Patent
Ting et al.

(10) Patent No.: US 7,604,120 B2
(45) Date of Patent: Oct. 20, 2009

(54) CUSHION STRUCTURE

(75) Inventors: Chung-kuan Ting, Hsin-Chu (TW); Kun-hung Hsieh, Hsin-Chu (TW); Shr-chi Chen, Hsin-Chu (TW)

(73) Assignee: AU Optronics Crop., Hsin-Chu (TW)

( * ) Notice: Subject to any disclaimer, the term of this patent is extended or adjusted under 35 U.S.C. 154(b) by 84 days.

(21) Appl. No.: 11/843,501

(22) Filed: Aug. 22, 2007

(65) Prior Publication Data

US 2008/0149519 A1 Jun. 26, 2008

(30) Foreign Application Priority Data

Dec. 20, 2006 (TW) ..... 95147898 A

(51) Int. Cl.
*B65D 85/48* (2006.01)

(52) U.S. Cl. ..... 206/454; 206/587; 206/592

(58) Field of Classification Search ..... 206/576, 206/320, 453, 454, 455, 583, 586, 591, 592, 206/594, 721, 723
See application file for complete search history.

(56) References Cited

U.S. PATENT DOCUMENTS

| | | | | |
|---|---|---|---|---|
| 4,792,043 | A * | 12/1988 | Holladay | 206/594 |
| 5,398,808 | A * | 3/1995 | Chen et al. | 206/320 |
| 5,823,352 | A * | 10/1998 | Mena et al. | 206/721 |
| 5,950,817 | A | 9/1999 | Iwamoto et al. | |
| 6,253,917 | B1 * | 7/2001 | Wilson, Jr. | 206/453 |
| 6,268,039 | B1 * | 7/2001 | Chou et al. | 206/586 |
| 7,296,680 | B2 * | 11/2007 | Yokawa | 206/521 |
| 7,374,044 | B2 * | 5/2008 | Ting | 206/454 |

FOREIGN PATENT DOCUMENTS

| | | |
|---|---|---|
| JP | 8258866 | 10/1996 |
| JP | 9-2530 | 7/1997 |
| JP | 10211938 | 8/1998 |
| TW | 258080 | 3/2005 |
| TW | 275194 | 9/2005 |

* cited by examiner

*Primary Examiner*—Luan K Bui

(57) ABSTRACT

Disclosed is a cushion structure, which includes a box, a holding structure and a first cushion therein. The first cushion includes a bearing part, two buffer parts and two supporting parts. The buffer parts are joined with two sides of the bearing part to form a first angle and a second angle. The supporting parts are joined with opposite sides to the sides of the buffer parts joined with the buffer parts to form a third angle and a fourth angle. The cushion structure further includes a second cushion disposed parallel to the first cushion between the box and the holding structure. Alternatively, the second cushion can be disposed opposite to or superimposed over the first cushion between the first cushion and the holding structure. Both the first and second cushions can be formed as one-piece.

7 Claims, 8 Drawing Sheets

CUSHION STRUCTURE

FIELD OF THE INVENTION

The present invention generally relates to a cushion structure, and more particularly to a cushion structure to protect thin fragile goods or thin articles.

BACKGROUND OF THE INVENTION

Generally, people use a box, a holding structure inside the box to pack thin fragile goods before the thin fragile goods are delivered. Moreover, styrofoam is commonly used to fill-up the empty spaces inside the box. The box, the holding structure, and the styrofoam, buffer any shock made to the box to prevent the thin fragile goods or thin articles from being damaged by the shock. However, material such as styrofoam causes environmental pollution and is not easily recycled. So, in recent years, styrofoam production for packing and filling-up the empty spaces inside the box has been drastically reduced because of the concept of saving earth's resources and protecting ecological environment. Realizing environmental protection has become a major concern all over the world, therefore, using the same material as the box for the holding structure and for filling-up the empty spaces which causes no pollution and is easy for recycling is a trend.

At times, the aforesaid shock made to the box can be a force applied on an area of the box equally, and sometimes, the aforesaid shock can be a puncture to one point of the box. Therefore, for using the same material for the box and the packing structure, there are several methods for preventing the thin fragile goods or thin articles from being damaged by the shock, such as, increasing the rigidity of the box (increasing the thickness), increasing buffer spaces (empty spaces) inside the box, strengthening the packing structure (complicating the packing structure) or making the packing structure all around the thin fragile goods or thin articles to realize the achievement of protection.

However, all the aforesaid methods have some unavoidable drawbacks as follows:

Increasing the rigidity of the box (increasing the thickness) increases material costs and occupied spaces resulting in rising packing cost and delivering cost. Increasing buffer spaces (empty spaces) inside the box increases the occupied spaces of the box resulting in rising delivering cost. Strengthening the packing structure (complicating the packing structure) complicates the manufacture and the fabrication of the packing structure resulting in rising the manufacturing cost. Making the packing structure all around the thin fragile goods or thin articles increases material costs and occupied spaces resulting in rising packing costs, the delivering costs and complicates the fabrication of the packing structure.

Therefore, it is a trend to increase the rigidity of the box and to decrease buffer spaces inside the box to buffer the shock made to the box for preventing the goods or thin articles inside from being damaged by the shock. It is beneficial to design a cushion structure which is made with the same material as the box that the cushion structure can further decrease size of the box and without increasing the rigidity of the box in order to reduce the packing cost and can also protect the goods or thin articles inside the box.

SUMMARY OF THE INVENTION

An objective of the present invention is to provide a cushion structure to absorb shock in order to protect goods or thin articles inside when the cushion structure is receiving shock.

Another objective of the present invention is to provide a cushion structure complemented to a box to absorb the shock made to the goods or thin articles inside the cushion structure and also decreasing the rigidity of the box.

For achieving the objectives of the present invention, the cushion structure includes a box, a holding structure and a first cushion. The first cushion includes a bearing part with two sides, two buffer parts and two supporting parts. The holding structure is placed inside the box. The first cushion is placed between the box and the holding structure. The two buffer parts are joined with two sides of the bearing part to form a first angle and a second angle. The two supporting parts are joined with opposite sides to the sides of the buffer parts joined with the bearing parts to form a third angle and a fourth angle.

The holding structure of the present invention includes an under holder, two side holders and a cap holder. The under holder is placed at the bottom inside the box. The two side holders are put as two opposite sides inside the box respectively and joined with the under holder. The cap holder is disposed opposite to the under holder and joined with the side holders. Each of the two side holders has an adapter for joining with cut openings of the two supporting parts, respectively. The bearing part and the two supporting parts are boards. The bearing part is parallel with a side of the box. The two supporting parts are parallel with the bearing part.

The cushion structure of the present invention may further include a second cushion. The structure of the second cushion is similar to the first cushion. The second cushion can be placed between the box and the holding structure and parallel with the first cushion. Alternatively, the second cushion can be placed between the box and the holding structure and opposite to or superimposed over the first cushion.

Either the first cushion or the second cushion can be formed as one-piece. The first cushion and the second cushion is made of a corrugated paperboard, a pulp modeled board or a honeycomb paperboard to achieve the most benefit of the environmental protection and economics. Moreover, a plastic corrugated paperboard for increasing the rigidity of the cushion structures is also considered.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
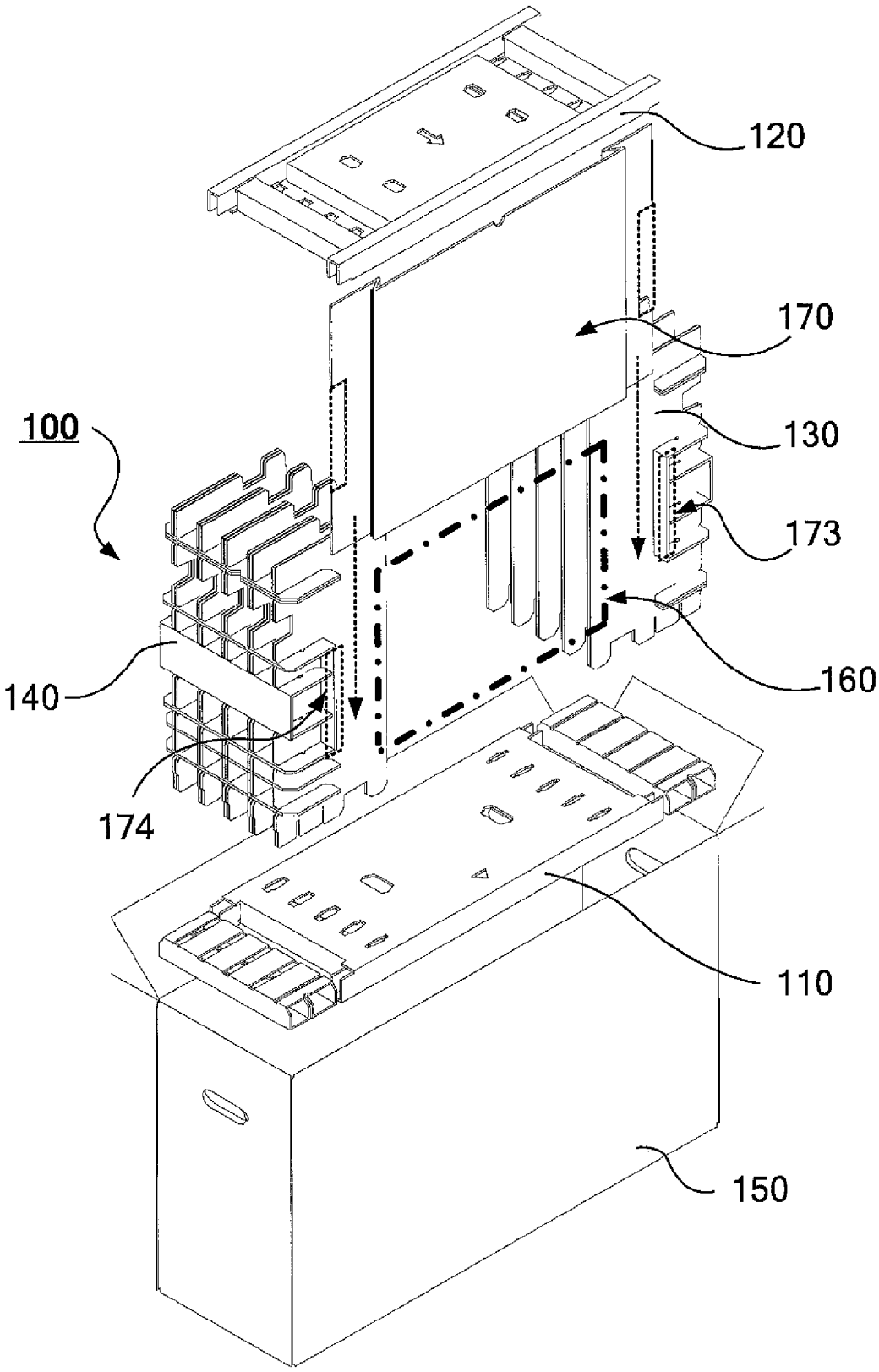
FIG. 1 illustrates a relationship diagram of a first cushion, a holding structure and a box of the present invention.

FIG. 1 illustrates a relationship diagram of a first cushion 170, a holding structure 100, and a box 150 of the present invention. The holding structure 100 includes an under holder 110, a cap holder 120 and two side holders 130, 140. After putting several thin articles into the slots of the two side holders 130, 140, the under holder 110, the two side holders 130, 140 with the thin articles therein, and the cap holder 120 are put in the box 150 in proper order. Then, a first cushion 170 is placed between the box 150 and the holding structure 100 with the goods or thin articles as indicated by the dotted-line arrows to form a cushion structure protecting area 160. Moreover, adapted cut openings on first cushion 170 are joined with adapters 173, 174 of the two side holders 130, 140 respectively. The first cushion 170 is joined with the side holder 130 with the adapter 173. The first cushion 170 is joined with the side holder 140 with the adapter 174. Therefore, the relative oppositions of the first cushion 170 and the holding structure 100 are maintained steadily. The displacement between the first cushion 170 and holding structure 100 will not occur as to protect the thin articles therein when shock happens on the box.

Figure 2A:
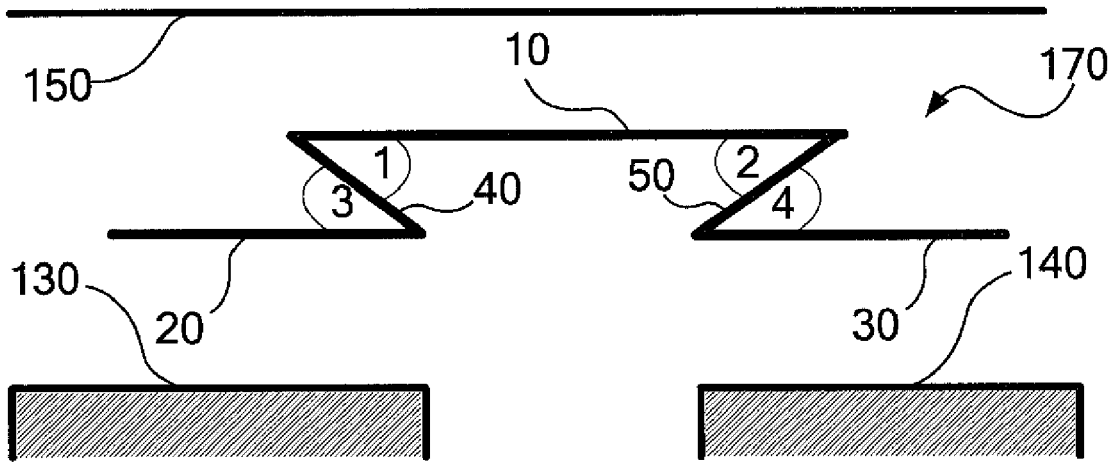
FIG. 2A, FIG. 2B, and FIG. 2C illustrate diagrams of first embodiment according to the present invention.
Figure 2B:
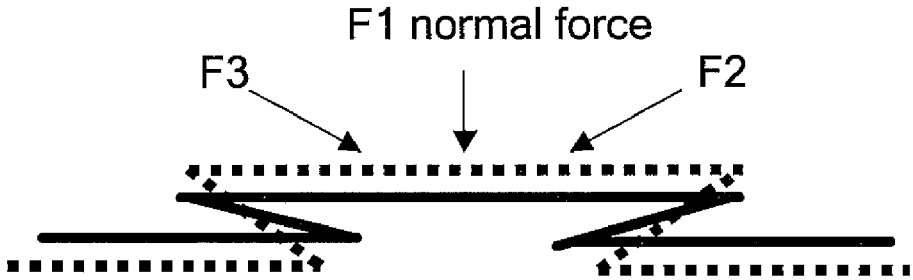
Figure 2C:
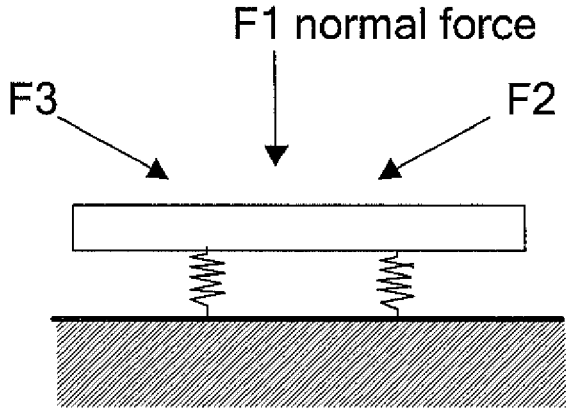

FIGS. 2A, 2B and 2C illustrate diagrams of first embodiment according to the present invention. FIG. 2A shows relationship among two side holders 130, 140, a box 150 and a first cushion 170 after the first cushion 170 is placed in the box 150 according to the first embodiment. The first cushion 170 faces a corresponding side of the box 150 with a bearing part 10 to receive shock (a normal force F1, a force F2 or a force F3 which is not a normal force) averagely. The two buffer parts 40, 50 are joined with two sides of the bearing part 10 to form a first angle 1 and a second angle 2. The two supporting parts 20, 30 are joined with the buffer parts 40, 50 to form a third angle 3 and a fourth angle 4.

Meanwhile, the two supporting parts 20, 30 are joined with the two side holders 130, 140 of the holding structure 100 to resist the shock with the first cushion 170 averagely at the same time. The first cushion 170 can be made of a corrugated paperboard, a pulp modeled board or a honeycomb paperboard. Dotted lines corresponding to the first, second, third and fourth angles dividing the bearing part 10, the supporting parts 20, 30 and the buffer parts 40, 50 can be generated on the surface of the paperboard (first cushion 170) in advance for bending along the broken lines of the paperboard to form the first cushion 170 in one-piece. FIG. 2B is a diagram showing deformation of the first cushion 170 caused by received force. FIG. 2C is an explanation diagram of the first cushion 170 that can have an effect as a spring device. When the first cushion 170 is shocked (by a normal force F1, a force F2 or a force F3 which is not a normal force) with the changed first angle 1 and second angle 2, the shape of the bearing part 10 and the buffer parts 40, 50 is changed. With the changed third angle 3 and fourth angle 4, the shape of the buffer parts 40, 50 and the supporting parts 20, 30 is changed. The intensity of the force perpendicular to the inner side of the box is dispersed and transferred to the intensity of the force parallel to the inner side of the box. When the force is dispersed and transferred as aforementioned, it is also transferred to the side holder 130, 140 as to allow the holing structure 100 to resist the shock with the first cushion 170 at the same time.

The first cushion 170 buffers the shock and protects the goods or thin articles inside similarly as a spring device shown in FIG. 2C to absorb the shock. Therefore, with the first cushion 170 of the present invention, the buffer space between the box 150 and the holding structure can be decreased. The method of increasing the rigidity of the box according to the prior art can be abandoned. Moreover, a box 150 having weaker rigidity can be done by choosing to decrease the material cost according to the present invention. Such as using the corrugated paperboard, the number of the walls constructing the corrugated paperboard can be less with the protection of the first cushion 170. The fewer the number of walls that construct the corrugated paperboard, the lower the material cost of the box 150 is.

Figure 3A:
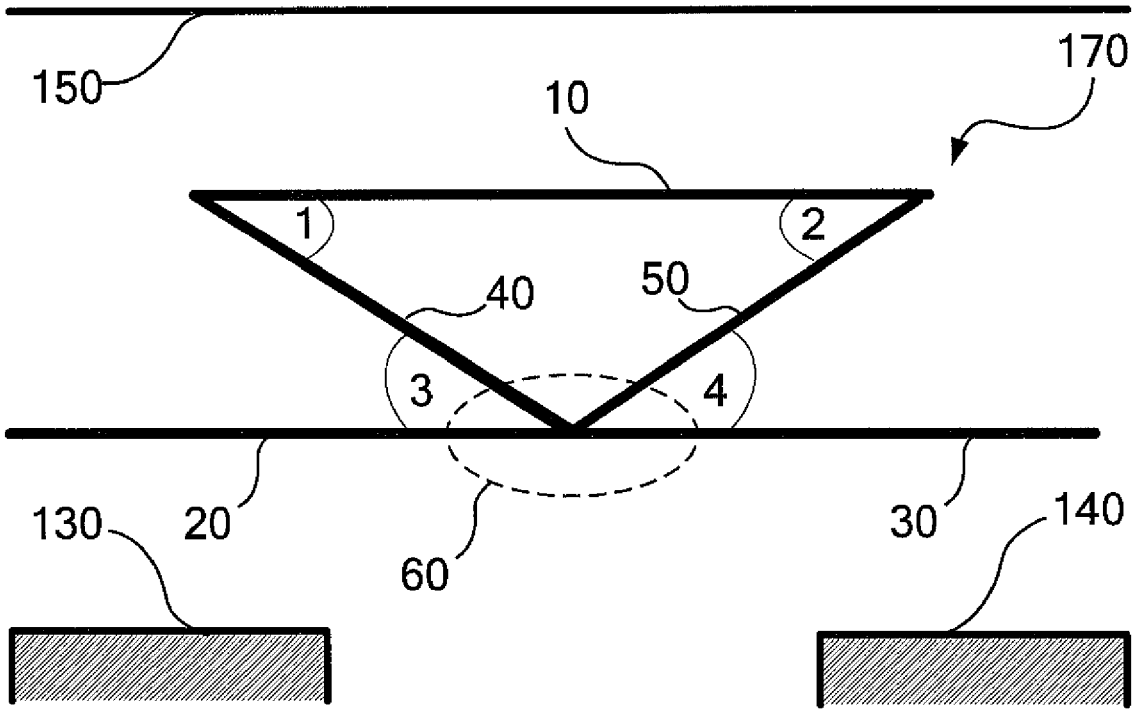
FIG. 3A and FIG. 3B illustrate diagrams of second embodiment according to the present invention.
Figure 3B:
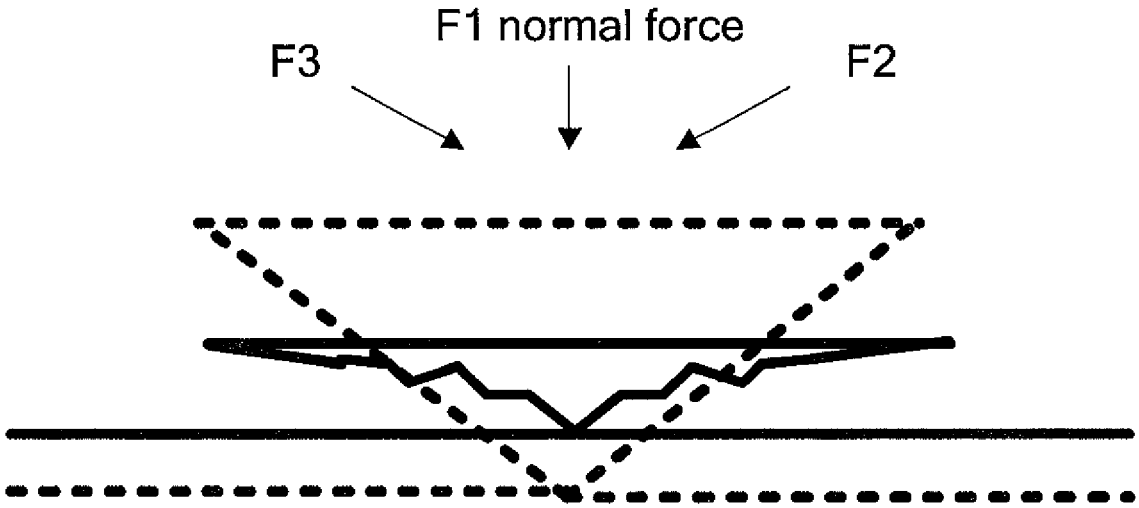

FIGS. 3A and 3B illustrate diagrams of second embodiment according to the present invention. Specifically, FIG. 3A shows relationship among two side holders 130, 140, a box 150 and a first cushion 170 after the first cushion 170 is placed in the box 150 according to the second embodiment. The first cushion 170 in this embodiment is similar to that of the first embodiment but the supporting parts 20, 30 are joined with each other fixedly at the third angle 3 and the fourth angle 4 to form a joint unit 60 as shown in the dotted-line-ellipse in FIG. 3A. The buffer parts 40, 50 and the bearing part 10 form a fixed triangle to increase the rigidity of the first cushion 170. Such as using the corrugated paperboard, generating cut openings at the third angle 3 and corresponding adapters at the fourth angle 4 to embed the supporting parts 20, 30 in each other can be realized.

FIG. 3B is a diagram, which shows deformation of the first cushion 170 caused by received force. The bearing part 10 and the buffer parts 40, 50 form a fixed triangle. The buffer parts 40, 50 are destructively collapsed to resist the shock as shown in FIG. 3B to buffer the shock and protect the goods inside when the first cushion 170 is shocked (by a normal force F1, a force F2 or a force F3 which is not a normal force).

Figure 4A:
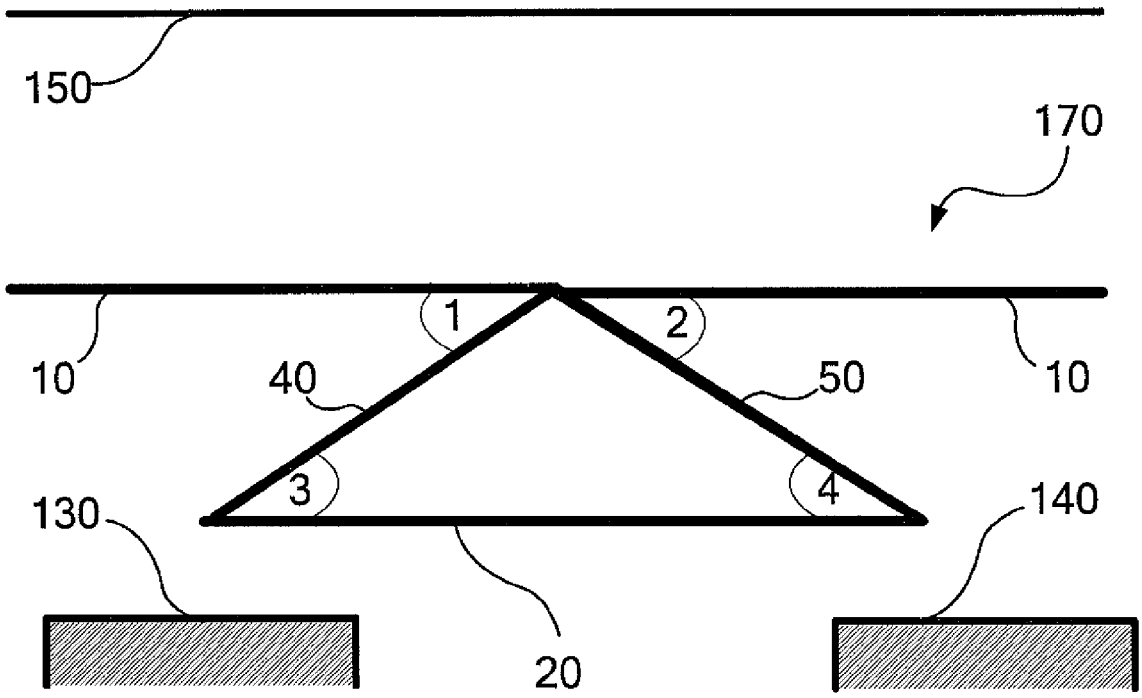
FIG. 4A and FIG. 4B illustrate diagrams of third embodiment according to the present invention.
Figure 4B:
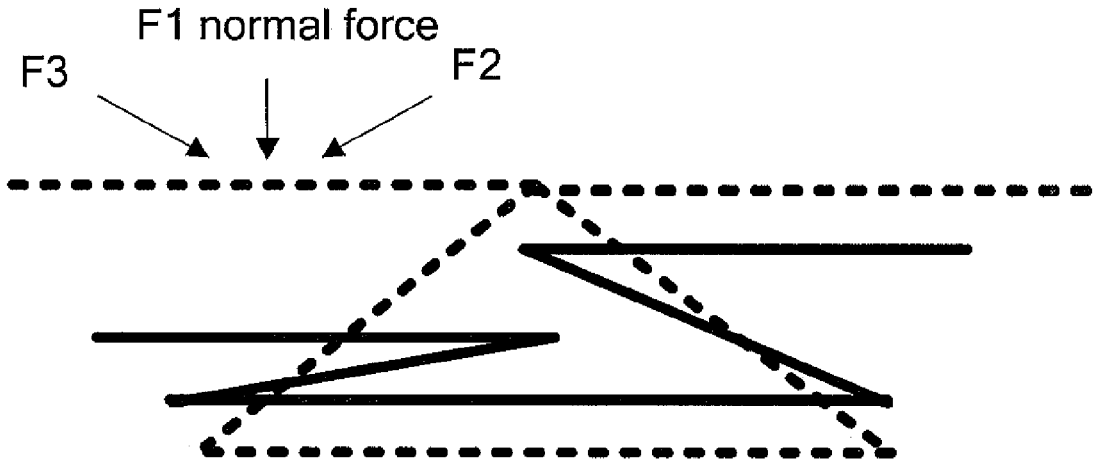

FIGS. 4A and 4B illustrate diagrams of third embodiment according to the present invention. Specifically, FIG. 4A shows relationship of two side holders 130, 140, a box 150 and a first cushion 170 after the first cushion 170 is placed inside the box 150 according to the third embodiment. The first cushion 170 faces a corresponding side of the box 150 with two bearing parts 10 to receive the shock (a normal force F1, a force F2 or a force F3 which is not a normal force) averagely. The buffer parts 40, 50 are joined with the two bearing parts 10 to form a first angle 1 and a second angle 2. The supporting part 20 is joined with the buffer parts 40, 50 to form a third angle 3 and a fourth angle 4. Meanwhile, the supporting part 20 is joined with the two side holders 130, 140 of the holding structure 100 to resist the shock with the first cushion 170 averagely at the same time.

FIG. 4B is a diagram, which shows deformation of the first cushion 170 caused by received force. The two bearing parts 10 individually effect similarly as a spring device shown in FIG. 2C to resist the normal force F1. No matter the shock is a normal force F1, a force F2 or a force F3 which is not a normal force, the first cushion 170 buffers the shock and protects the goods inside.

Figure 5A:
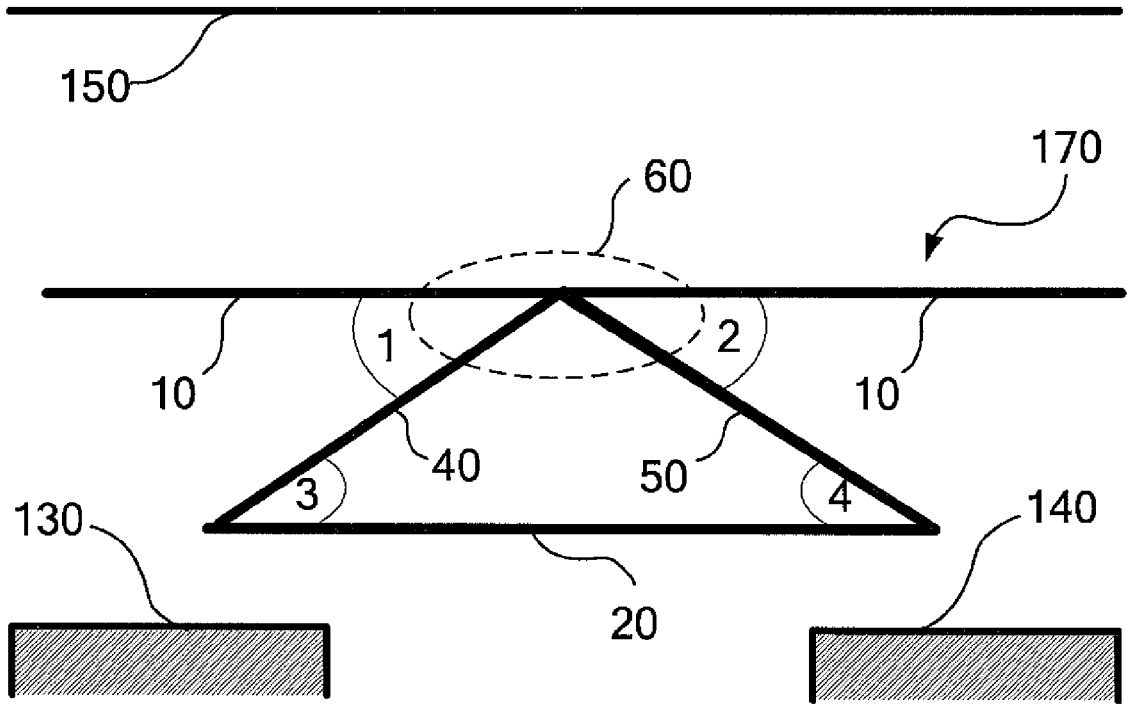
FIG. 5A and FIG. 5B illustrate diagrams of fourth embodiment according to the present invention.
Figure 5B:
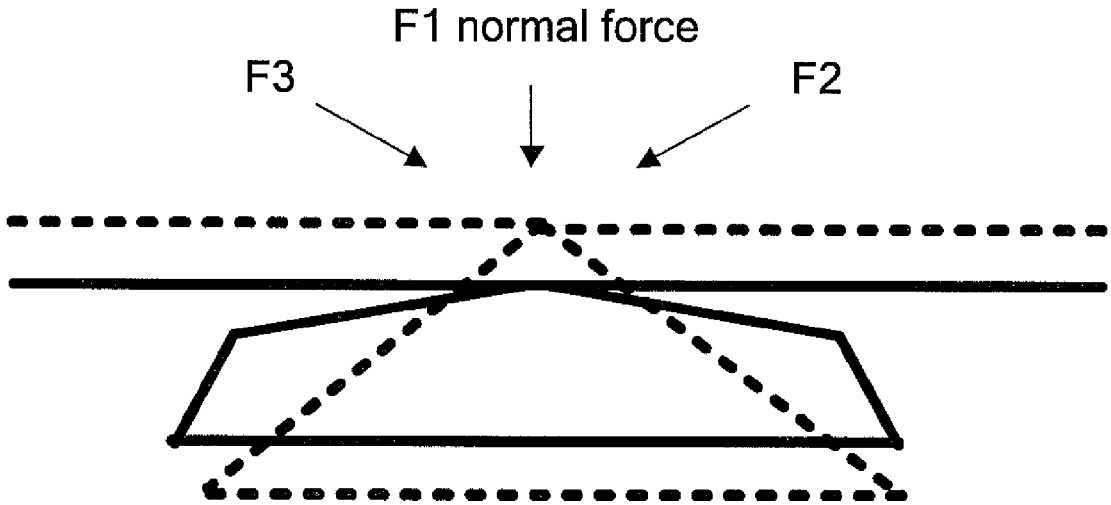

FIGS. 5A and 5B illustrate diagrams of fourth embodiment according to the present invention. Specifically, FIG. 5A shows relationship of two side holders 130, 140, a box 150 and a first cushion 170 after the first cushion 170 is placed inside the box 150 according to the fourth embodiment. The first cushion 170 in this embodiment is similar to that of the third embodiment but the two bearing parts 10 are joined with each other fixedly at the first angle 1 and the second angle 2 to form a joint unit 60 as shown in the dotted-line-ellipse in FIG. 5A. Furthermore, several dotted lines can be generated at the buffer parts 40, 50 in advance. The deformation of the first cushion 170 generates at these dotted lines when the bearing parts 10 receive the shock.

FIG. 5B is a diagram, which shows deformation of the first cushion 170 caused by received force. The deformation of the first cushion 170 generates at these broken lines to buffer the shock and protect the goods inside when the first cushion 170 is shocked (by a normal force F1, a force F2 or a force F3 which is not a normal force).

Moreover, the present invention further provides first, sixth, seventh, eighth and ninth embodiments of the first cushion 170 below.

Figure 6:
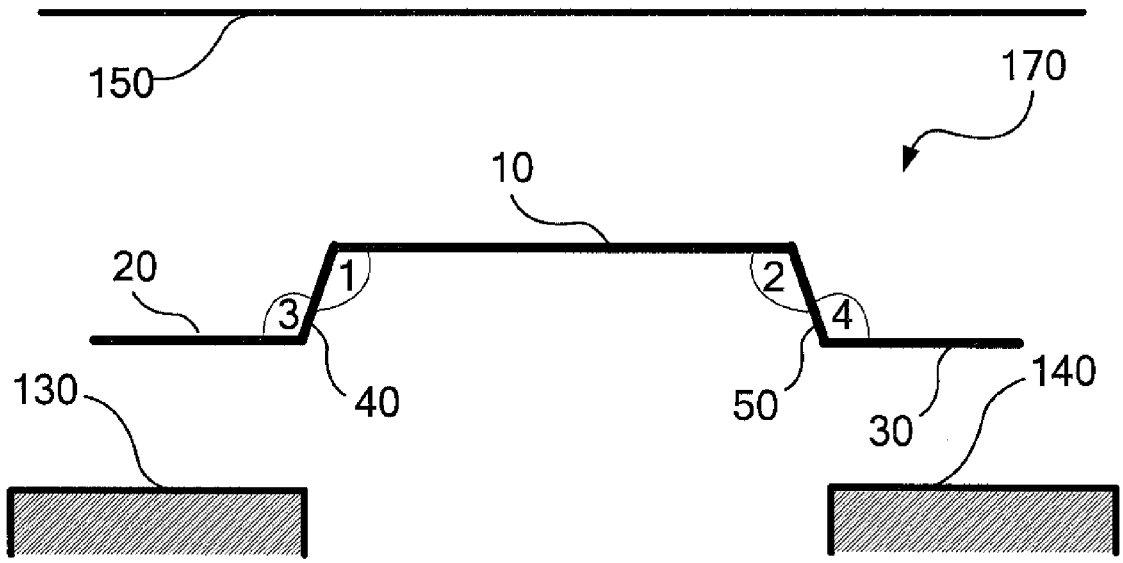
FIG. 6 illustrates a diagram of fifth embodiment according to the present invention.

FIG. 6 illustrates a diagram of fifth embodiment according to the present invention. In this embodiment, the first cushion 170 faces a corresponding side of the box 150 with a bearing part 10 to receive the shock averagely. The two buffer parts 40, 50 are joined with the bearing part 10 to form a first angle 1 and a second angle 2. The two supporting parts 20, 30 are joined with the buffer parts 40, 50 to form a third angle 3 and a fourth angle 4. Comparing with the first embodiment, the first, second, third and fourth angles 1, 2, 3, 4 are acute angles but are obtuse angles in this embodiment. Alternatively, these angles 1, 2, 3, 4 are also can be right angles.

The first cushion 170 forms a firm trapezoid after the supporting parts 20, 30 are joined with the holding structure 100. The holding structure 100 resists the shock with the first cushion 170 averagely at the same time to buffer the shock and protect the goods or thin articles inside when the bearing part 10 receives the shock. Same as each aforesaid embodiment, the first cushion 170 can be formed as one-piece. Moreover, as similarly described as the fourth embodiment, several dotted lines can be generated at the buffer parts 40, 50 in advance. The deformation of the first cushion 170 generates at these dotted lines when the bearing parts 10 receive the shock.

Figure 7:
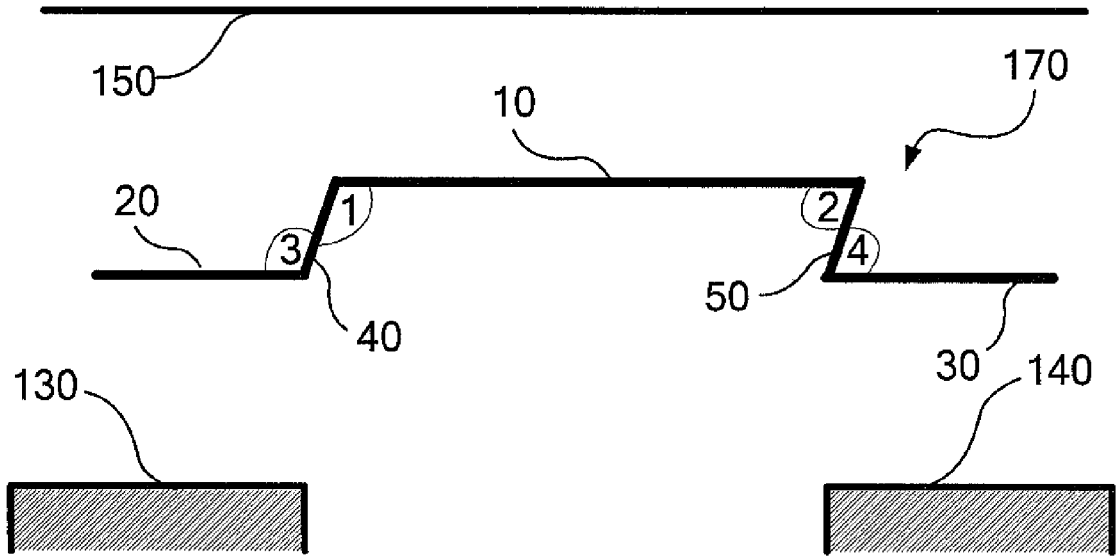
FIG. 7 illustrates a diagram of sixth embodiment according to the present invention.

FIG. 7 illustrates a diagram of sixth embodiment according to the present invention. The first cushion 170 faces a corresponding side of the box 150 with a bearing part 10 to receive the shock averagely. The two buffer parts 40, 50 are joined with the bearing part 10 to form a first angle 1 and a second angle 2. The two supporting parts 20, 30 are joined with the buffer parts 40, 50 to form a third angle 3 and a fourth angle 4. The first angle 1 and the third angle 3 are equal obtuse angles. The second angle 2 and the fourth angle 4 are equal acute angles. Same as each aforesaid embodiment, the first cushion 170 cane be formed as one-piece.

Figure 8:
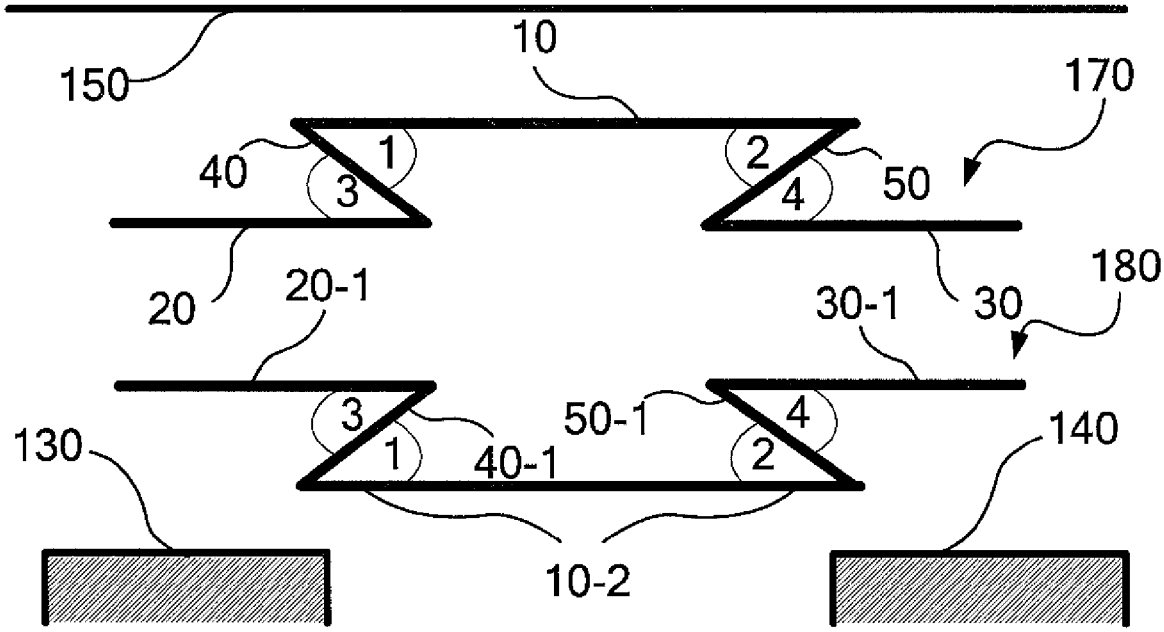
FIG. 8 illustrates a diagram of seventh embodiment according to the present invention.

FIG. 8 illustrates a diagram of seventh embodiment according to the present invention. In this embodiment, the first cushion 170 faces a corresponding side of the box 150 with a bearing part 10 to receive the shock averagely. The two buffer parts 40, 50 are joined with the bearing part 10 to form a first angle 1 and a second angle 2. The two supporting parts 20, 30 are joined with the buffer parts 40, 50 to form a third angle 3 and a fourth angle 4. The cushion structure of the present invention further includes as second cushion 180 placed between first cushion 170 and the holding structure 100. The structure of the second cushion 180 is similar to the first cushion 170 and opposite to the first cushion 170. The supporting parts 20-1, 30-1 of the second cushion 180 face the supporting parts 20, 30 of the first cushion 170. The bearing part 10-1 is joined with the side holder 130, 140. The bearing part 10-1 is joined with the two buffer parts 40-1, 50-1 to form a first angle 1 and a second angle 2. The two supporting parts 20-1, 30-1 are joined with the buffer parts 40-1, 50-1 to form a third angle 3 and a fourth angle 4. Therefore, the buffer quantity of the cushion structure of the present invention is enhanced. Same as each aforesaid embodiment, the first cushion 170 can be formed as one-piece. The second cushion 180 also can be formed as one-piece.

Figure 9:
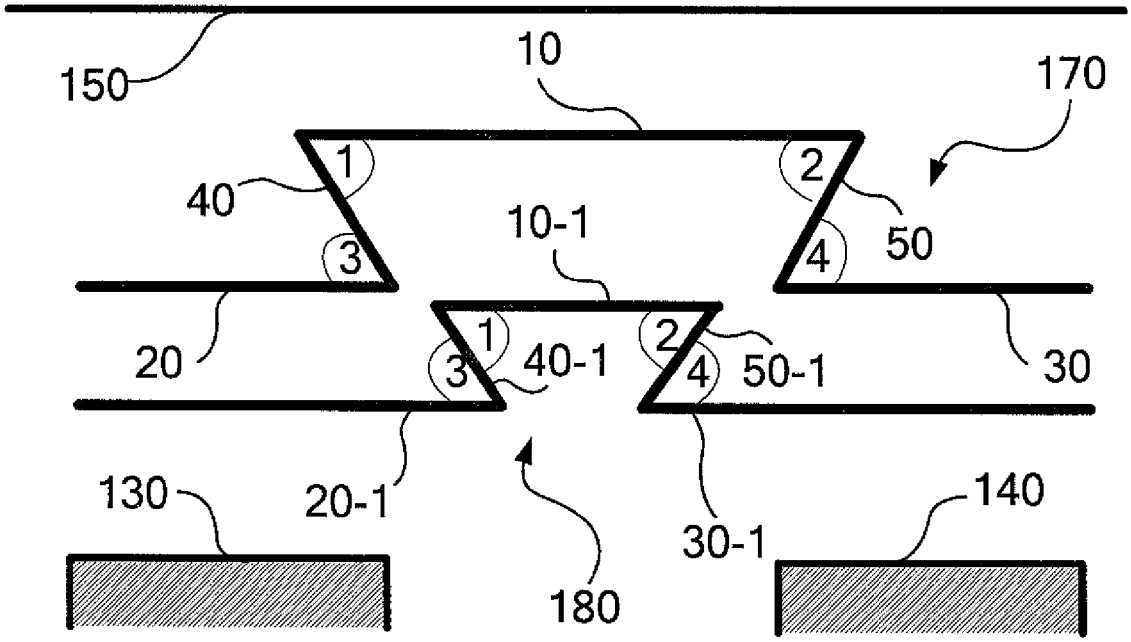
FIG. 9 illustrates a diagram of eighth embodiment according to the present invention.

FIG. 9 illustrates a diagram of eighth embodiment according to the present invention. In this embodiment, the first cushion 170 faces a corresponding side of the box 150 with a bearing part 10 to receive the shock averagely. The two buffer parts 40, 50 are joined with the bearing part 10 to form a first angle 1 and a second angle 2. The two supporting parts 20, 30 are joined with the buffer parts 40, 50 to form a third angle 3 and a fourth angle 4. The cushion structure of the present invention farther includes as second cushion 180 placed between first cushion 170 and the holding structure 100. The structure of the second cushion 180 is similar to the first cushion 170 and superimposed over the first cushion 170.

Figure 10:
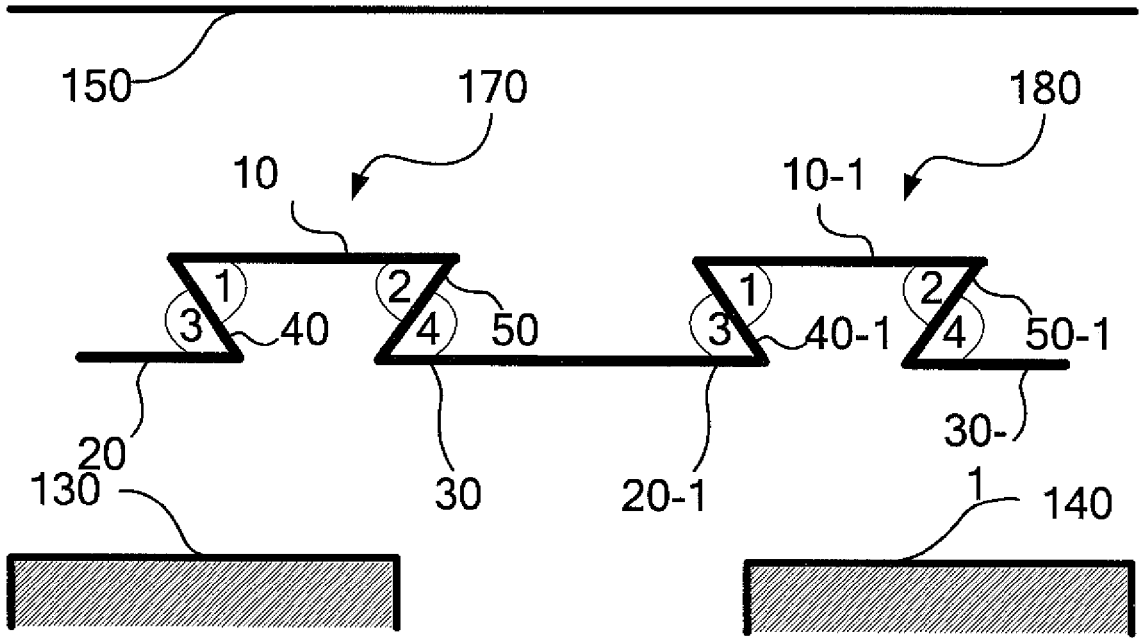
FIG. 10 illustrates a diagram of ninth embodiment according to the present invention.

The bearing part 10-1 of the second cushion 180 touches or is parallel with the bearing part 10 of the first cushion 170. The two buffer parts 40-1, 50-1 are joined with the bearing part 10-1 to form a first angle 1 and a second angle 2. The two supporting parts 20-1, 30-1 are joined with the buffer parts 40-1, 50-1 to form a third angle 3 and a fourth angle 4. The supporting parts 20-1, 30-1 are also superimposed over the supporting parts 20, 30 of the first cushion 170. Therefore, the buffer quantity of the cushion structure of the present invention is enhanced. The first cushion 170 and the second cushion 180 resist the shock at the same time to buffer the shock and protect the goods or thin articles inside FIG. 10 illustrates a diagram of ninth embodiment according to the present invention. In this embodiment, the cushion structure of the present invention further includes a second cushion 180 placed between the box 150 and the holding structure 100. The structure of the second cushion 180 is similar to the first cushion 170 and parallel with the first cushion 170. The bearing part 10 of the first cushion 170 and the bearing part 10-1 of the second cushion 180 face a corresponding side of the box 150 with a bearing part 10 to receive the shock averagely. The two buffer parts 40, 50 of the first cushion 170 are joined with the bearing part 10 to form a first angle 1 and a second angle 2. The two buffer parts 40-1, 50-1 of the second cushion 180 are joined with the bearing part 10-1 to form a first angle 1 and a second angle 2 also. The two supporting parts 20, 30 of the first cushion 170 are joined with the buffer parts 40, 50 to form a third angle 3 and a fourth angle 4. The two supporting parts 20-1, 30-1 of the second cushion 180 are joined with the buffer parts 40, 50 to form a third angle 3 and a fourth angle 4 also. Same as each aforesaid embodiment, the first cushion 170 and the second cushion 180 can be formed as one-piece.

In all the embodiments of the present invention, either the first cushion 170 or t the second cushion 180 can be made of a corrugated paperboard, a pulp modeled board or a honeycomb paperboard but these are not limitation to the present invention. The first, second, third and fourth angles can be all equal or some of them can be equal. For example, the first angle is equal to the third angle. The second angle is equal to the fourth angle as mentioned in the sixth embodiment. The first, second, third and fourth angles can be acute angles, right angles or obtuse angles. The bearing parts and the supporting parts are all boards parallel with a side of the box.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A cushion structure, comprising:

a box;

a holding structure placed inside the box, comprising:

an under holder placed at the bottom inside the box;

two side holders put as two opposite sides inside the box respectively and joined with the under holder; and a cap holder disposed opposite to the under holder and joined with the side holders; and a first cushion placed between the box and the holding structure, the first cushion comprising:

a bearing part with two sides, facing a corresponding inner side of the box for receiving a shock to the box;

two buffer parts joined with the two sides of the bearing part to form a first angle and a second angle; and two supporting parts joined with opposite sides to the sides of the buffer parts joined with the bearing parts to form a third angle and a fourth angle, wherein each of the two side holders has an adapter for joining with the two supporting parts, respectively to resist the shock with the first cushion averagely at the same time.

2. The cushion structure of claim 1, wherein the first, second, third and fourth angles are acute angles, right angles or obtuse angles.

3. The cushion structure of claim 1, wherein the bearing part is a board parallel with a side of the box.

4. The cushion structure of claim 1, wherein the two supporting parts are boards parallel with the bearing part.

5. The cushion structure of claim 1, wherein the first angle is equal to the third angle and the second angle is equal to the fourth angle.

6. The cushion structure of claim 1, wherein the first cushion is formed as one-piece.

7. The cushion structure of claim 1, wherein the first cushion is made of corrugated paperboard, a pulp modeled board, or a honeycomb paperboard.

* * * * *